United States Patent [19]

Conn

[11] 4,333,509

[45] Jun. 8, 1982

[54] SECTIONAL VENETIAN BLINDS

[75] Inventor: William H. Conn, Pasadena, Calif.

[73] Assignee: Ohline Corporation, Gardena, Calif.

[21] Appl. No.: 87,029

[22] Filed: Oct. 22, 1979

[51] Int. Cl.[3] ..... E06B 9/386

[52] U.S. Cl. ..... 160/173; 160/236; 403/14; 403/292

[58] Field of Search ..... 160/236, 168, 173; 403/292, 13, 14

[56] References Cited

U.S. PATENT DOCUMENTS

| | | | |
|---|---|---|---|
| 1,213,063 | 1/1917 | Benson | 403/292 X |
| 2,012,034 | 8/1935 | Brent . | |
| 2,017,210 | 10/1935 | Kirsch | 160/236 X |
| 2,122,224 | 6/1938 | Wade et al. . | |
| 2,123,010 | 7/1938 | Kahn . | |
| 2,152,117 | 3/1939 | Wade et al. . | |
| 2,170,938 | 8/1939 | Carreras et al. . | |
| 2,254,705 | 9/1941 | Morse | 160/236 X |
| 2,311,716 | 2/1943 | Walker . | |
| 2,314,461 | 3/1943 | Schaefer . | |
| 2,317,659 | 4/1943 | Williams . | |
| 2,365,004 | 12/1944 | Rice et al. . | |
| 2,447,706 | 8/1948 | Marston | 160/173 |
| 2,521,151 | 9/1950 | Cusick . | |
| 2,532,617 | 12/1950 | Hauser et al. . | |
| 2,547,260 | 4/1951 | Foglio . | |
| 2,576,160 | 11/1951 | Walker . | |
| 2,588,550 | 3/1952 | Martin et al. . | |
| 2,643,713 | 6/1953 | Mayer . | |
| 2,796,927 | 6/1957 | Evans . | |
| 2,872,259 | 2/1959 | Thorpe | 108/69 |
| 3,086,586 | 4/1963 | Wolfe . | |
| 3,802,206 | 4/1974 | Moore et al. | 403/292 X |

FOREIGN PATENT DOCUMENTS

| | | | |
|---|---|---|---|
| 1947439 | 5/1971 | Fed. Rep. of Germany | 403/13 |
| 328819 | 3/1958 | Switzerland | 403/292 |

*Primary Examiner*—Rodney H. Bonck
*Attorney, Agent, or Firm*—Henry M. Bissell

[57] ABSTRACT

A sectioned Venetian blind slat and mechanism for joining the sections thereof to permit a broken slat to be replaced without the necessity of taking the entire blind to a repair shop. Fabrication of slats through the use of the joint mechanisms of the invention results in simplification of manufacturing techniques and the realization of economies through being able to use shorter pieces of wood such as were formerly treated as scrap in the manufacture of full length slats. Contrasting shades of wood sections may be employed to develop a contrasting pattern in a blind.

15 Claims, 4 Drawing Figures

SECTIONAL VENETIAN BLINDS

BACKGROUND OF THE INVENTION

1. Field of the Invention

This invention relates to Venetian blinds and, more particularly, to the construction of louvers or slats for use in such blinds.

2. Description of the Prior Art

Wooden-slat Venetian blinds, once popular forty or fifty years ago, are coming back into vogue for certain custom installations, for use in homes in medium and upper price range, and in certain offices and institutions after having been substantially displaced by metal-slat Venetian blinds. The wooden-slat Venetian blinds tend to provide a richer look, more in keeping with current decorator trends.

Wooden-slat Venetian blinds, as presently constructed, comprise a plurality of slats or louvers supported, at least toward the opposite ends of the slats (opposite sides of the blind), by so-called ladders comprising a pair of angle or tilt control strings located on opposite sides of the slats and a lift string extending vertically through the centers of the slats. Extending generally horizontally between the tilt strings and spaced vertically in accordance with the width of the slats, is a series of cross strings or tapes which serve to support the respective slats in appropriately spaced relationship. Each slat is, of course, provided with a central opening through which the lift string extends. This opening is elongated in the transverse direction of the slat in order to permit the slats to be tilted through a substantial angle in opening or closing the blind without interference between the slats and the lift strings. By varying the vertical positions of the tilt strings of a single ladder with respect to each other—and thereby the angles of the cross tapes extending between them—the slats are rotated in unison, thereby opening and closing the blind. The blind may be lifted entirely to the top of the associated window or other space where it is installed by causing the lift string to be pulled upwardly, as over a pulley arrangement in the head piece of the blind, thereby lifting the bottom rail of the blind and pulling all of the slats up with it as the slack is taken up by the lift string.

It may readily be seen that the wooden slats of blinds which are so constructed have an inherent weakness in the longitudinal portion adjacent the transverse openings for the lift strings. When a slat breaks, it is most likely to fail at this point. Also, wooden slats have somewhat of a tendency to warp, thus presenting a problem which is not present in the Venetian blinds made of metal slats or some other material. While it is a relatively simple matter to remove an individual slat from the blind simply by breaking it at the point where the ladders are situated, a new slat cannot be installed without taking apart the entire blind.

Sectioned louvers for Venetian blinds have been known in the prior art; see the Carreras et al. U.S. Pat. No. 2,170,938, for example, which discloses a Venetian blind louver fabricated of sections which are joined by especially constructed metal clips. The stated purpose of this construction is to adapt the louvers to extra large windows or windows of odd dimensions from louvers initially manufactured to lengths of certain standard dimensions.

There are numerous examples in the prior art of means for detaching slats from blinds without disassembling the entire blind. Among these are slats provided with T-shaped end slots as in the Carreras et al. patent and in U.S. Pat. Nos. 2,521,151 of Cusick and 2,643,713 of Mayer; side slots are disclosed in U.S. Pat. Nos. 2,123,010 of Kahn, 2,588,550 of Martin et al. and 3,086,586 of Wolfe; detachable cords as in the U.S. Pat. Nos. 2,012,034 of Brent, 2,547,260 of Foglio, and 2,314,461 of Schaefer; and detachable clips as disclosed in U.S. Pat. Nos. 2,796,927 of Evans, 2,532,617 of Hauser et al., 2,365,004 of Rice et al., 2,122,224 and 2,152,117 of Wade et al., 2,311,716 and 2,576,160 of Walker, and 2,317,659 of Williams. None of these, insofar as can be determined, deals with the problem which is solved by the present invention.

SUMMARY OF THE INVENTION

In brief, arrangements in accordance with the present invention include a joint for a sectioned slat of a wooden Venetian blind, the joint being constructed for joining the slat sections at points where the lift strings and tilt ladders are positioned. The end of a slat section to be joined is cut transversely and provided with a notch to form, with a corresponding notch in the other slat section to be joined, an opening as described above for the lift string which serves to permit tilting of the slats without interference therewith. For one standard size of slat, in the portions of the slat sections outboard of the notches, tiny holes of approximately 0.025 inch in diameter are drilled longitudinally of the sections. Thereafter a pair of pins of generally the same diameter (approximately 0.027 inch in this example) are inserted in two of these holes and the two sections are then brought together with the pins from the one section being now inserted into the holes in the second section. For ease of assembly, one of the pins is made to extend outward farther than the other, so that only one pin at a time need be inserted in its corresponding hole as the two sections are brought together to be joined. When the joining is completed, the pins are entirely enclosed within the ends of the slat sections and the juncture line between the sections is almost invisible. If joined sections of different colors, shades, hues or stains are utilized, a very striking pattern can be developed from the assembled sections joined in the manner described to make up a Venetian blind.

Fabrication of blinds utilizing joined sections to make up the individual louvers in accordance with the invention advantageously serves to cut down on the waste heretofore encountered in the manufacture of wooden Venetian blinds. Louvers of any length desired can be made up of shorter sections, all of which can be standard and fabricated of pieces of wood that would otherwise be discarded. Not only is waste diminished by being able to use such shorter pieces of wood, but considerable economy is effected in inventories required to stock the slats to be assembled into blinds, since the longer louvers can be made up of a number of standard sections.

For the home owner or other user of blinds manufactured in accordance with the present invention, economies may also be realized because retailers can now stock blind repair kits comprising replacement slat sections matched to length and color or shade of a given blind by a series of identification numbers. Such kits permit the home owner to replace a broken or warped section or the slat itself without having to send the blind to a shop for complete disassembly and repair. Furthermore, joined slats constructed in accordance with the present invention are stronger than the longer one-piece slats heretofore employed because of the fact that the weakest point (the slat portion adjacent the lift string opening most subject to breakage) is eliminated and in its stead planed butt ends are provided, held together by steel pins. The joints constructed as described are capable of accepting stresses in excess of those which serve to break single piece wooden louvers of the prior art as above described. Where such prior art blinds exist, when the owner encounters a broken or warped slat, he may very easily replace it with one of the kits incorporating slat sections and the components for joining same, as described hereinabove.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENTS

Figure 1:
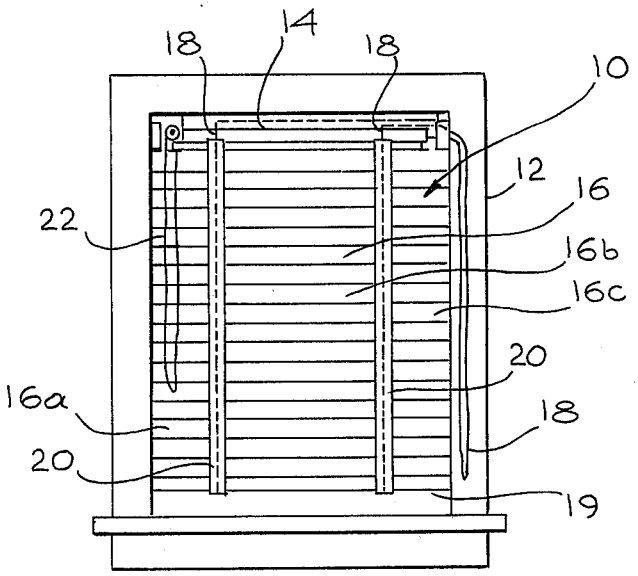
FIG. 1 is an elevational view showing a Venetian blind, which may be of the conventional type, but in which arrangements in accordance with the invention may be utilized.

FIG. 1 is an illustration of a Venetian blind 10 shown in a typical installation within a window frame 12. The Venetian blind has the appearance of a conventional blind of the prior art but may as well comprise embodiments of the present invention. As shown, the blind 10 includes a head piece 14 supporting a plurality of slats or louvers 16 by means of lift strings 18. These strings 18 are carried across by means of pulleys or other guides within the housing of the head piece 14 and dropped down on the right-hand side where they may be used to raise and lower the slats 16 of the blind 10, as desired. The lift strings are secured to a bottom rail 19 which serves to lift the individual slats in succession as the bottom rail is pulled upward by the lift cords 18. Tilt strings shown in the form of tapes 20 are coupled to a mechanism within the housing of the head piece 14 and extending to the tilt cord 22 for adjusting the angle or tilt of the individual slats 16 in unison. Typically the tilt of the slats 16 can be varied through an angle of 300 degrees or more. Where the blind 10 of FIG. 1 incorporates sectioned slats in accordance with the present invention, each of the individual slats 16 would be typically made up of sections 16*a*, 16*b* and 16*c*.

Figure 2:
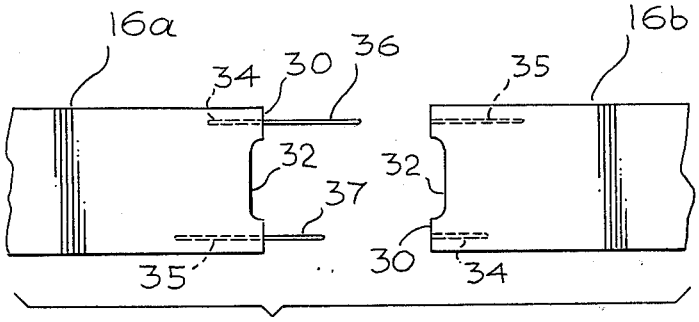
FIG. 2 is a plan view showing portions of two louver sections and the joining mechanism in accordance with the present invention.
Figure 3:
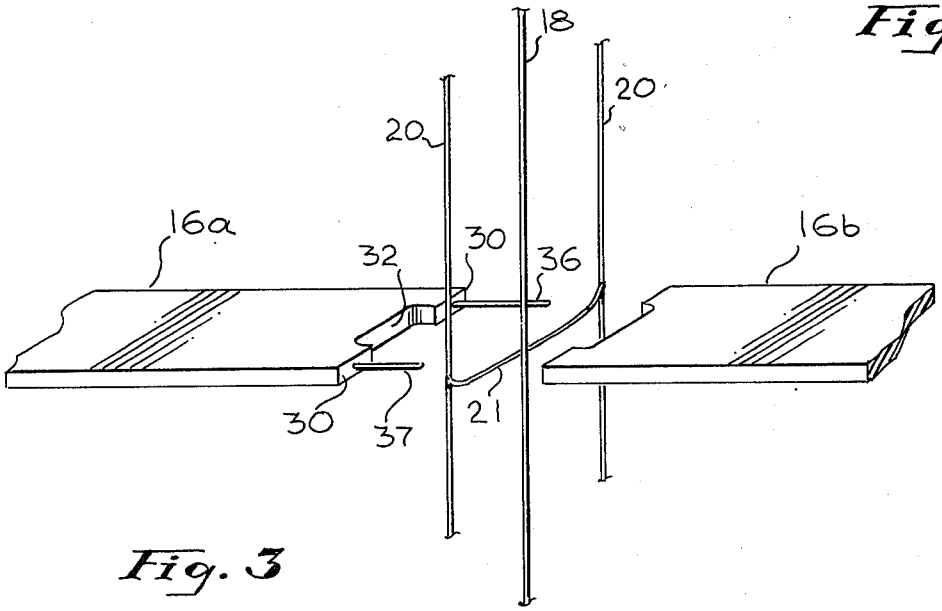
FIG. 3 is a perspective view of a portion of a Venetian blind illustrating the use of arrangements in accordance with the present invention.

FIGS. 2 and 3 illustrate a mechanism for joining adjacent sections to form a sectioned slat in accordance with the present invention, fashioned so as to permit ready removal and replacement of a slat within a blind. As shown in these figures, two adjacent sections such as 16*a* and 16*b* are shown ready to be joined together. Each of the sections has been fabricated to provide squared-off end surfaces 30 between which a notch 32 is cut. In addition, holes 34 and 35 are drilled longitudinally from the end surfaces 30 into the sections 16*a*, 16*b*. Pins 36, 37 are inserted respectively in the holes 34, 35 of the sections 16*a*. The two adjacent ends of sections 16*a*, 16*b* are then placed in position on opposite sides of a slat supporting combination comprising the lift string 18 and tilt strings 20, the latter being provided within individual slat-supporting cross strings 21, and pushed together with pins 36, 37 entering the respective holes 35, 34 of section 16*b* until the opposed butt surfaces 30 of both sections 16*a*, 16*b* are in contact with each other. At this point, the juncture between the sections appears as a very fine line, virtually invisible without close inspection in most cases where the two joined sections are of the same color or, particularly, where the sections are stained the same and the wood grain is not distinctively different in the two sections.

It will be noted from FIG. 2 that the holes 34, 35 are of different lengths. This is to accommodate pins 37, 38 of equal lengths which, when bottomed in the holes 34, 35, are left with their free ends projecting outwardly by different distances from the section 16*a*. This arrangement facilitates the alignment of the pins 36, 37 into the holes 35, 34 in section 16*b*, since the pin 36 is entered into hole 35 before the pin 37 begins to enter the hole 34.

Figure 4:
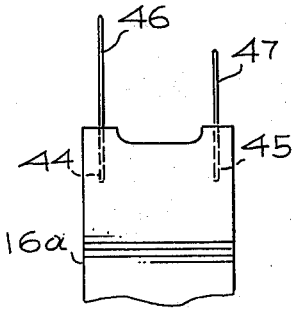
FIG. 4 is a plan view illustrating a variant of the arrangement of FIG. 2.

An alternative arrangement for accomplishing this beneficial result is shown in FIG. 4, wherein holes 44, 45 of equal length are drilled in a section such as 16*a*. In this arrangement, pins 46, 47 are provided of different lengths so that when the pins are bottomed in the holes 44, 45 their outer ends project by different lengths from the section 16*a*. The same result obtains: in joining section 16*a* with an adjacent section, pin 46 would enter the corresponding hole and be aligned therein before the end of pin 47 encounters its corresponding hole.

Arrangements in accordance with the present invention advantageously provide a new kind of sectioned slat or louver for Venetian blinds and the like which particularly facilitates the repair of Venetian blinds having broken or warped slats therein by providing a means whereby a replacement slat can very easily be installed in sections after the slat to be replaced is removed, as by breaking it at the points adjacent the lift strings. Utilization of arrangements in accordance with the present invention in the manufacture of Venetian blinds admits of economies to be realized from reduction of waste resulting from being able to use shorter pieces of wood for the slat sections and lower inventory cost through being able to make up slats of many different lengths by joining various standard-size sections. As another advantage from the utilization of the present invention, a blind such as 10 in FIG. 1 can be more attractively coordinated with decorator colors of its surroundings by using individual sections in different colors to provide different color patterns in a single blind. For example, sections 16*a* and 16*c* can be of the same color, whereas section 16*b* can be of a contrasting color. Alternatively, the contrast between end sections and center sections can be alternated from top to bottom in a checkerboard or other pattern, as desired.

Although there have been described above specific arrangements of a sectioned Venetian blind in accordance with the invention for purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as claimed in the appended claims.

What is claimed is:

1. A Venetian blind having a plurality of slats supported in spaced relationship by a support structure which includes at least a pair of lift strings threaded through the slats in positions on opposite sides of the center plane of the blind, at least one of the slats being constructed in sections situated on opposite sides of a lift string, the sectioned slat having a joint encircling the lift string, said joint comprising adjacent end portions of said slat sections shaped for joining together in abutting relationship and concealed joining means encased within said end portions, said joining means comprising a plurality of pins mounted to extend from at least one abutting end portion for insertion into the other abutting end portion so as to be totally concealed within the sectioned slat joint.

2. The blind of claim 1 wherein the joining means releasably join a pair of sections in abutting relationship enclosing the lift string.

3. The blind of claim 2 wherein the abutting ends adjacent joined sections are shaped to define an opening, the edges of which extend completely about the associated lift string.

4. The blind of claim 3 wherein the joining means comprises a pair of pins for mounting in longitudinal holes drilled in the slat sections from abutting edges thereof, the two pins and associated holes being positioned on opposite sides of the opening.

5. The blind of claim 4 wherein the holes in one section are of equal length, the pins being of unequal length to facilitate aligning and joining the adjacent section to the pins.

6. The blind of claim 4 wherein the pins are of equal length and the associated holes are of unequal depth to permit the free ends of the pins to be staggered in order to facilitate aligning and joining the adjacent section to the pins.

7. A sectioned slat for installation in a blind of claim 1 comprising a plurality of sections having corresponding ends shaped for joining together in abutting relationship; and means for joining the abutting ends of the sections in a position surrounding one of the lift strings, said joining means comprising a plurality of pins mounted to extend from at least one abutting end for insertion into the other abutting end so as to be totally concealed when the slat is assembled.

8. The slat of claim 7 wherein said abutting ends are each shaped with a central recessed portion, the recessed portions jointly defining an opening and completely encircling the lift string when the sections are joined together in position in the blind.

9. The device of claim 7 wherein the joining means comprise a pair of pins for longitudinal alignment within longitudinal holes drilled in abutting faces of the sections, said pins serving to releasably join the sections and hold them in fixed juxtaposition relative to each other when the sections are positioned in abutting relationship in the blind.

10. The device of claim 9 wherein the longitudinal holes are of differing depths while the pins are of equal length in order to develop a staggered position of the pins when inserted in the holes of one section so that the pins can be aligned one at a time with corresponding holes in the other section during the joining together of two sections.

11. The device of claim 9 wherein the longitudinal holes in one section are of equal depth and the pins are of differing length so as to develop a staggered position of the pins when inserted in the holes of one section so that the pins can be aligned one at a time with corresponding holes in the other section during the joining together of two sections.

12. The device of claim 7 wherein the section ends abutting together are squared off to permit joining of adjacent sections with a virtually invisible juncture line.

13. The device of claim 7 wherein the slat sections are formed with two opposed, broad, generally planar and parallel opposed faces extending the thickness and width of the section.

14. The device of claim 13 wherein the slat sections are formed of generally flat elongated pieces of wood.

15. The device of claim 14 wherein the ends to be joined are shaped symmetrically with both said end portions having notches therein of like shape, extent and position.

* * * * *